US006076317A

United States Patent [19]

Hellwig et al.

[11] Patent Number: 6,076,317

[45] Date of Patent: Jun. 20, 2000

[54] LIGHTWEIGHT BRIDGE FOR OFFICE PANELLING SYSTEMS

[75] Inventors: John Hellwig; Jonathan Liberty, both of Toronto; Lorie Marangoni, Weston, all of Canada

[73] Assignee: Teknion Furniture Systems Limited

[21] Appl. No.: 08/843,143

[22] Filed: Apr. 28, 1997

[30] Foreign Application Priority Data

Mar. 6, 1997 [CA] Canada ..... 2199314

[51] Int. Cl.[7] ..... E04B 2/00

[52] U.S. Cl. ..... 52/239; 52/36.1; 52/220.7

[58] Field of Search ..... 52/36.1, 36.4, 52/36.5, 36.6, 220.7, 239; 160/135, 351

[56] References Cited

U.S. PATENT DOCUMENTS

| | | | |
|---|---|---|---|
| 2,134,389 | 10/1938 | Gessler | 52/239 |
| 2,240,484 | 5/1941 | Anderson | 52/239 |
| 4,144,924 | 3/1979 | Vanden Hoek | 160/231 |
| 4,203,639 | 5/1980 | Vanden Hoek et al. | 339/22 |
| 4,569,163 | 2/1986 | Long | 52/36.1 |
| 4,630,416 | 12/1986 | Lapins et al. | 52/239 |
| 4,761,921 | 8/1988 | Nelson | 52/239 X |
| 4,852,317 | 8/1989 | Schiavello . | |
| 4,944,122 | 7/1990 | Wendt . | |
| 5,134,826 | 8/1992 | LaRoche . | |
| 5,212,918 | 5/1993 | Newhouse et al. | 160/351 X |
| 5,341,615 | 8/1994 | Hodges et al. | 52/220.7 |
| 5,511,348 | 4/1996 | Cornell et al. | 52/220.7 X |
| 5,560,418 | 10/1996 | Kissinger | 160/351 |
| 5,622,010 | 4/1997 | Weber | 52/36.1 X |
| 5,675,949 | 10/1997 | Forslund et al. | 52/220.7 |

FOREIGN PATENT DOCUMENTS

| | | |
|---|---|---|
| 0 557 092 | 8/1993 | European Pat. Off. . |
| 94 17 028 | 12/1994 | Germany . |

*Primary Examiner*—Carl D. Friedman
*Assistant Examiner*—Timothy B. Kang

[57] ABSTRACT

Workstations are defined using a combination of office panels and bridge arrangements which are attached to and project at an angle from a spine of office panels. The office panel frames which partially define a workstation provide the convenience of power and communication cabling within the panel frames. The bridge arrangements provide a lower cost alternative defining other walls of the workstation while also providing a system which can be rearranged easily. The bridge arrangements are preferably self supporting in an upright orientation and can easily be detached from a horizontal securing channel of an office panel frame and moved to a new position.

20 Claims, 4 Drawing Sheets

LIGHTWEIGHT BRIDGE FOR OFFICE PANELLING SYSTEMS

FIELD OF THE INVENTION

The present invention relates to office panelling systems and, in particular, relates to frame based office panels in combination with bridge arrangements for defining a work station.

BACKGROUND OF THE INVENTION

Frame based office panelling systems provide a very valuable system for subdividing a large office space into individual work stations. The office space is easily rearranged from time to time to accommodate a completely different layout. These office panelling systems typically use office panels which have a frame structure to which releasable elements are secured. These releasable elements are normally rectangular in shape and when removed from the frame, expose a hollow interior of the panel.

Teknion Furniture Systems offers such a frame based panelling system and the structure of this panelling system is generally shown in U.S. Pat. No. 4,535,577 which is incorporated herein by reference.

Frame based office panelling systems do provide for convenient distribution of both electrical power and communication wires to the individual work stations and also provide flexibility to reconfigure the work space.

Desking systems provide an alternate approach and are more common in Europe. The desks or work tables provide the support structure and light-weight screening members can be attached to the work surfaces to provide visual privacy.

Teknion Furniture Systems also offers a combined office panelling system and desking system which is disclosed in U.S. Pat. No. 5,428,928 which is incorporated herein by reference. This system allows desks or other work surfaces to be attached to an office panelling system and to depart from the panelling system at a point intermediate to the length of a panel.

In addition to these two basic types of office systems, there have always been separate stand alone conference tables which can move about the office to suit the particular needs of the users. In addition, there have been mobile file storage units and mobile computer stations to allow many different users to use the equipment from time to time.

Prior to frame based office panelling systems, it was known to have a cooperating free standing partition screens which typically had a fixed core, such that access to the interior of the partition was not available. These screens could support different office accessories, either from the top of the screen or from the vertical edges of the screens.

SUMMARY OF THE INVENTION

An office panelling system according to the present invention comprises a series of connected office panels in combination with bridge arrangements which combination collectively sub-divides an open office space into a plurality of work stations. The office panels comprise a structural frame to which releasable rectangular-like elements are secured. These releasable elements define the dominant exterior finish to either side of the frame. The frame includes freely accessible support structures adjacent the elements for securing work station components from the panels via the support structure. Each bridge arrangement includes a partition forming a wall section of a work station with one end of the partition connected to one of the panel frames and an opposite end of the partition connected to a floor structural support member. The structural support member can be a further office panel, a floor engaging column member or other structure. The bridge component is supported at either end by structural members which render the bridge component stable. The partition is many times lighter to an equivalent length of an office panel.

According to an aspect of the invention, the partition of each bridge member has an exterior finish the same as the removable elements of the office panels.

According to a further aspect of the invention, the partition of each bridge arrangement is rectangular in shape and defines a large gap between a lower edge thereof and the floor along the length of the bridge.

According to a further aspect of the invention, the partition of each bridge member has a cardboard honeycomb interior to which the exterior finish is secured.

According to a further aspect of the invention, each bridge arrangement includes a structural frame about the partition which is releasably attached to one of the panel frames.

According to a further aspect of the invention the floor engaging column member is of a weight to oppose any accidental movement of the end of the bridge arrangement attached to the floor engaging column member.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
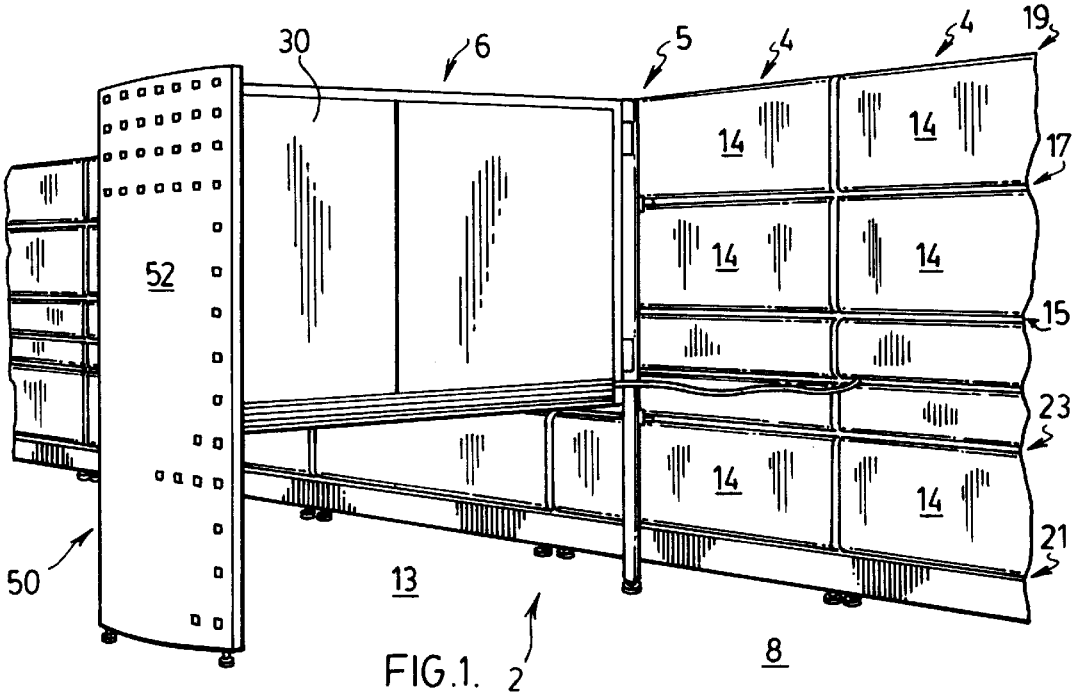
FIG. 1 is a partial perspective view showing a series of office panels connected in an end to end manner with a bridge arrangement connected at an angle to the panels.

The office panelling system 2 comprises a series of connected office panels 4 which are of the type having an interior frame to which removable, decorative or functional elements 14 are secured. In FIG. 1, the panel structural frame is generally shown as 10, but the precise details of the frame are shown in U.S. Pat. No. 4,535,577. Basically, the office panel frame is made of metal, having a exterior frame and a series of horizontal channel members which extend across the frame. These channel members are "U" shaped and each "U" shaped channel is accessible through the gap between adjacent vertically spaced panels. One such "U" shaped channel is shown as 12 in FIG. 4.

Figure 3:
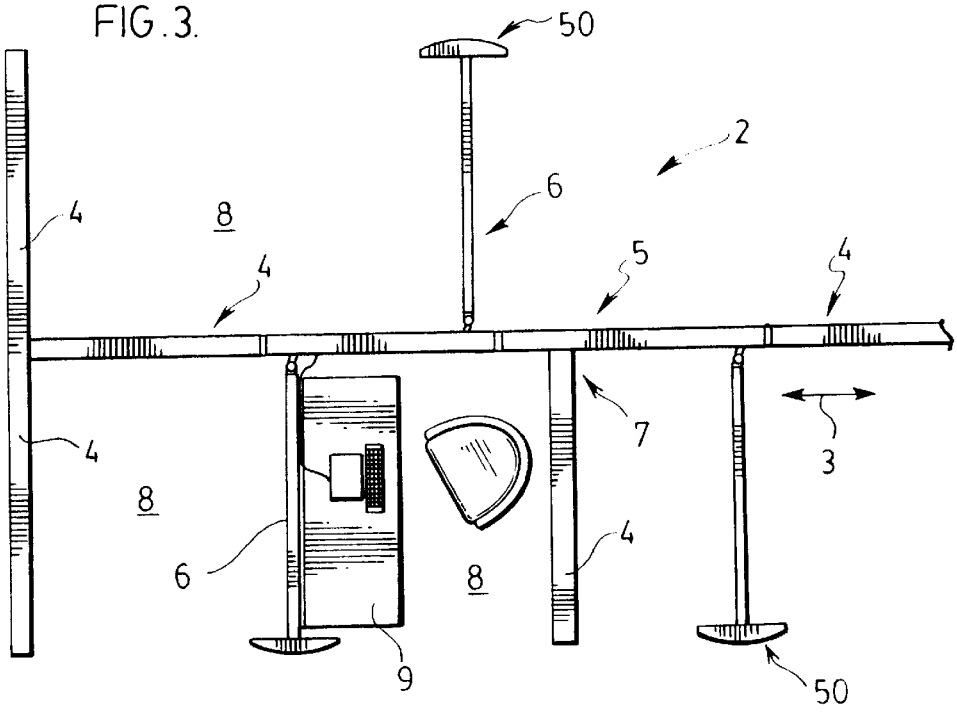
FIG. 3 is a partial top view showing a long spline of connected office panels with other office panels connected at 90° thereto, as well as bridge arrangements connected at 90° to the spline of panels.

In FIG. 1, a series of office panels 4 are connected in an end to end manner forming a spline to which bridge arrangements 6 or other office panels can extend in a perpendicular or angled manner. A combination of office panels and bridge arrangements at an angle to the spline are shown in the top view of FIG. 3. The spline of connected office panels is generally shown as 5 and at one end of the spline, office panels 4 form a "T" junction for support of the spline 5 of office panels. In addition, the bridge arrangements 6 also extend at an angle from the spline 5 and define a series of work stations 8. The office panels 4 at position 7, indicated in FIG. 3, are perpendicular to the spline and are connected to an office panel frame intermediate the length thereof (off module). Similarly, the bridge arrangement 6 can be connected to an office panel at any point along the length of the office panel. The office panelling system, partially shown in FIG. 3, is defined by a series of bridge arrangements 6 and a series of office panels forming a spline 5 with other office panels at an angle to the spline.

In FIG. 1, the bridge arrangement 6 provides visual privacy between two work stations, but does leave a gap, generally shown as 13, between a lower edge of the bridge arrangement and the floor. Preferably, the top of the bridge arrangement is positioned at the same height as the office panels 4 or at least at predetermined heights thereof (typically as a function of the elements). For example, it would be common to connect to the spline 5 of office panels a bridge arrangement or further office panels which are basically at any of the heights indicated as 15, 17 and 19. This defines a modular relationship between the office panels and the bridge arrangements and they need not all be the same height. The position indicated as 15 typically requires a bridge arrangement which extends to the level indicated as 21, preferably still leaving a small gap between the lower edge of the bridge and the floor. In many cases, the lower edge of the bridge terminates at a height indicated at 23 and in the case of the office panels shown in FIG. 1 would extend to the top of the office panels, i.e. at 19. It can be appreciated other arrangements are possible and these positions are preferred merely in that they are coordinated with the element position of the office panels.

Figure 6:
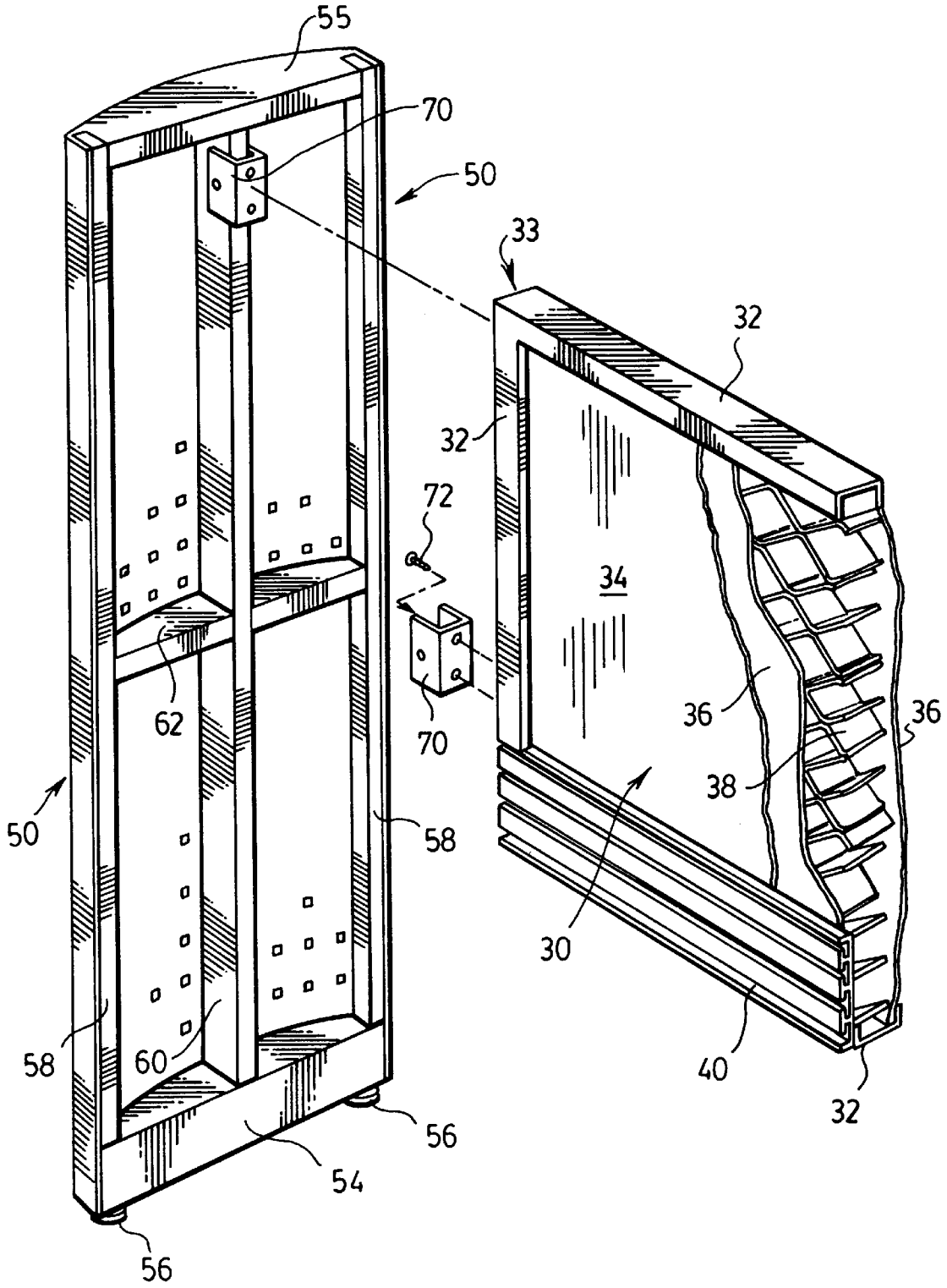
FIG. 6 is a partial perspective view showing securement of the partition to a column member at the free end of the bridge arrangement.

The bridge arrangement 6 includes an extension or floor engaging column member 50 at the free end of the rectangular partition 30. The rectangular partition 30 has a perimeter frame 32 thereabout made of extruded members that act as a structural frame about the partition 30. The partition 30 includes an exterior finish surface shown as 35 which can be upholstered, for example, to match the office panels 4 or can be of a related surface, such as a whiteboard or tackboard or other suitable surface. The rectangular partition 30 is preferably lightweight and it has been found that a lightweight honeycomb cardboard core 38 formed with two cardboard skins 36 as shown in FIG. 6 provides a strong tackable core.

The perimeter frame 32 adds a structural stiffness to the bridge arrangement and distributes loads to the spline 5 of office panels. Preferably, the partition includes a finish surface 34 which can be appropriately applied to the core prior to securement of the perimeter frame 32. The frame 32 at the end face 33 has a number of channel brackets 70 secured by fasteners 72 to the perimeter frame. These channel brackets also engage the central support 60 of the stanchion 50. The stanchion 50 has a curved foil shape and is relatively heavy in comparison to the rectangular partition 30. The stanchion 50 includes a curved exterior surface 52, in this case which is shown with a series of punched holes therein. This surface is attached to a frame. The frame includes the base 54, side frames 58, the central support 60, the horizontal support 62 and the top member 55. Height adjustable glides 56 can be secured to the base member 54. The stanchion 50 is designed to have substantial weight to anchor the bridge and oppose bridge movement if accidental forces are applied to the end of the bridge arrangement 6. It is found that the bridge arrangement has a very robust appearance and it provides the impression that it would be of similar strength to the office panels. The bridge arrangement, less the stanchion 50, is many times lighter than an equivalent length of office panels and, although strong, is easily moved if an accidental force is applied to the free end thereof. This problem is essentially solved by the stanchion 50 which, due to its weight, does not move easily. It can also be appreciated that in some layouts there will be desks to opposite sides of the bridge member which would oppose movement of the bridge, as the bridge is trapped between the two desks. The frame of the bridge arrangement is typically below desk level and would contact the desks and oppose accidental movement of the bridge.

The frame of the bridge arrangement is connected to the office panel frames and to the stanchion 50 forming a structural support maintaining the spline of office panels in a vertical orientation. The partition or core of the bridge strengthens this structural support and the bridge arrangement. This provides the necessary stability for the spline of office panels and forms a bridge frame arrangement which is strong but is not typically designed to carry the same loads as an office panel. If desired equipment can be supported by the bridge arrangement and the frame of the bridge could be robust for high load carrying capability.

The perimeter frame 32, in cooperation with the channel brackets 70, provide a simple means for securing of the partition 30 to the stanchion 50.

Figure 4:
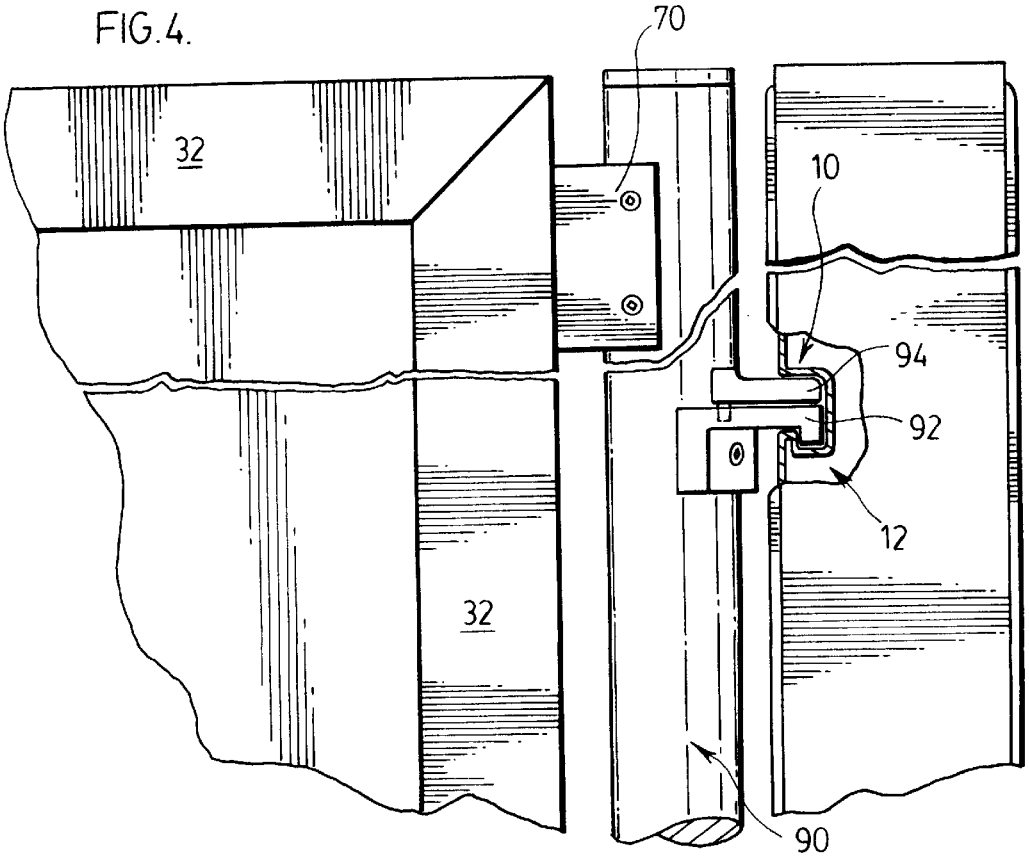
FIG. 4 is a partial perspective view showing attachment of a bridge arrangement to an office panel.

The opposite end of the bridge arrangement 6 and its attachment to an office panel frame is shown in FIG. 4. The perimeter frame 32 uses the channel brackets 70 which are secured to a cylindrical post 90. Again, a simple mechanical securement of the channel brackets 70 to the post 90 is preferred.

Figure 2:
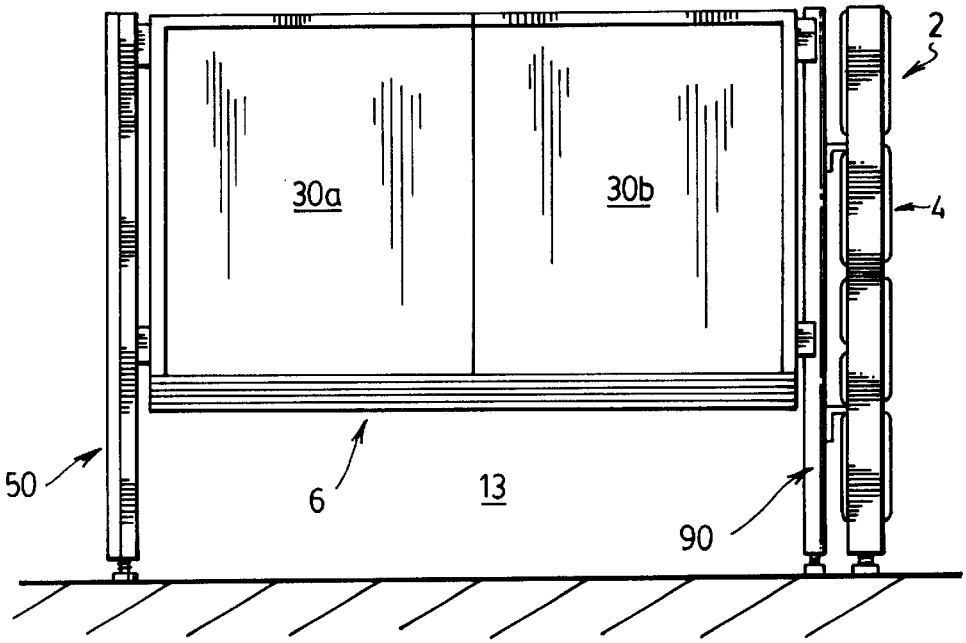
FIG. 2 is a side view of a bridge arrangement attached to an office panel.
Figure 5:
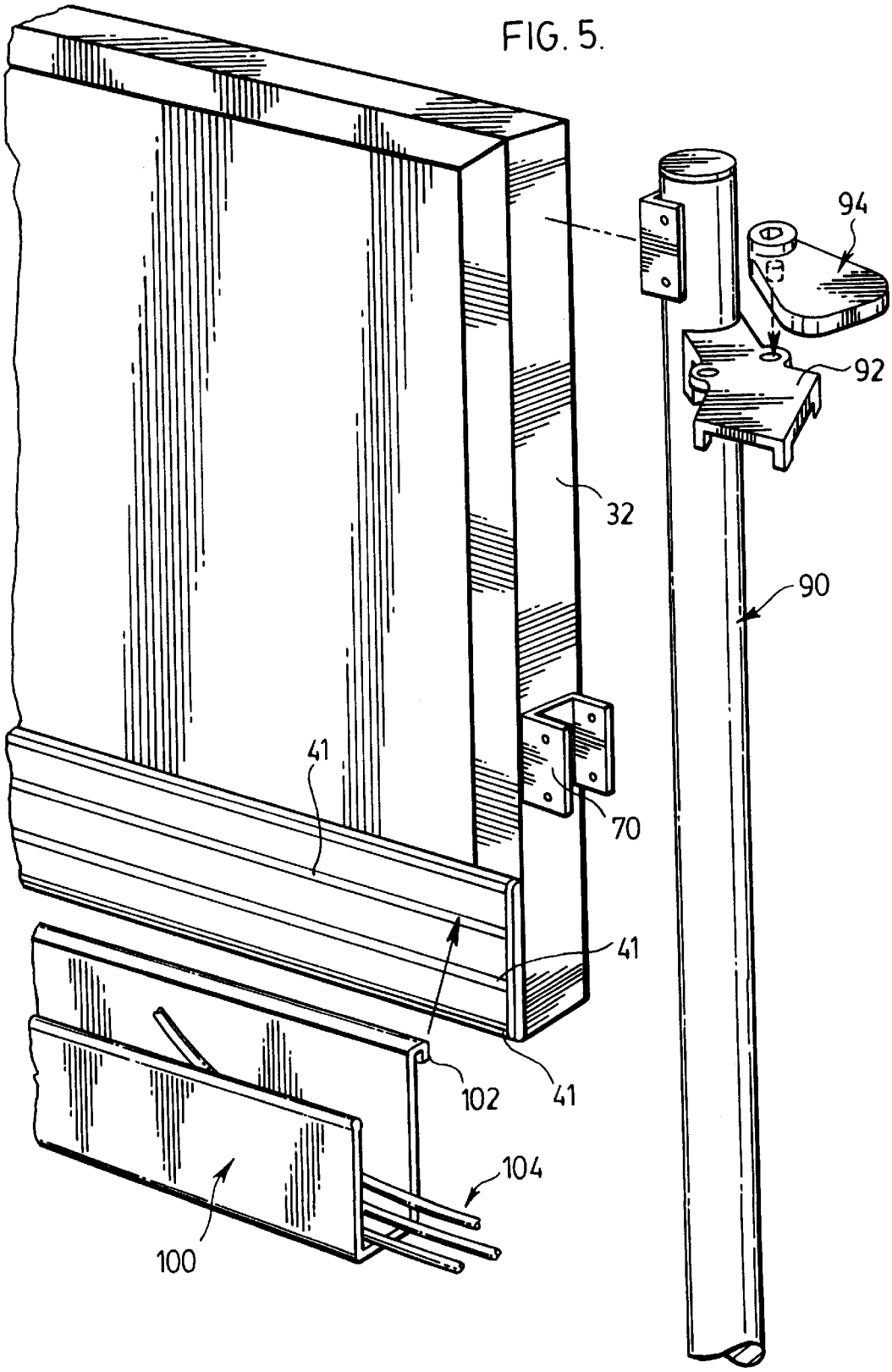
FIG. 5 is a partial perspective view showing attachment of a partition to a column member which in turn is attached to an office panel.

The opposite side of the post has a hook 92 positively secured thereto which, in cooperation with the pivoting cam latch 94 is used to secure the post 90 to the securing channel 12 of the office panel frame 10. Once the hook 92 has been inserted into the channel 12, the cam latch 94 may be pivoted to lock the hook in the channel. Details of this can further be appreciated from a review of FIG. 5. It is preferred that the post 90 is secured in at least two places to the panel frame by means of a pair of hooks 92 and the latches 94. Two such securements are shown in FIGS. 1 and 2.

The bridge arrangement 6 can also include an accessory slotted rail 40 at a lower edge thereof. This slotted rail is designed to receive the wiring trough 100, having a hook 102 for receipt in one of the slots 41. Other lightweight accessories can also use this rail.

As previously mentioned, the office panels 4 can have electrical wiring as well as communication wiring through the frame members to provide power and communication to the individual work stations 8. The bridge arrangement includes wire management preferably along the lower edge of the bridge. With a work surface placed to one side of the bridge, such as the work surface 9 shown in FIG. 3, a wiring trough 100 is secured to the lower edge of the bridge member and receives the communication wiring or power wiring generally indicated as 104 in FIG. 5. Preferably the office panels 4 allow for electrical connection of equipment to electrical outlets interior to the panel. Thus, in the work station which includes the surface 9, the normal electrical connection is made with a receptacle of the office panel 6 either interior to the office panel, such as shown in our earlier patent, or along an appropriate surface thereof in accordance with other systems. The wiring for the equipment supported on work surface 9 is placed in the casual wiring trough 100 attached to a bridge. Wiring is maintained off the floor and excess wiring is accumulated in the trough. This wiring can include a multi outlet extension cord. In this way, the work surface 9 remains uncluttered, and the full advantage of having convenient power at all locations within the work station is achieved. This wiring distribution can also be used for mobile tables adjacent a bridge arrangement. Such mobile tables can also have a casual wiring trough attached thereto immediately below the work surface.

The bridge arrangement 6 is at least three times lighter and is more cost effective than a similar length of office panels. The bridge arrangement is easy to handle, making installation of the system less labor demanding. With this arrangement, work stations are easily defined and advantageouly use office panels in critical locations where their full function can be utilized. In other locations where the full function of an office panel is not required and privacy is desired, the lightweight bridge members is used. These bridge arrangements provide excellent visual privacy and can also mimic the appearance of the office panels, including the full height of office panels, if desired. Each of the bridge arrangements can be detached from an office panel and moved to another location. The bridge arrangement, when secured to the stanchion and having the post 90 secured thereto is self supporting in the normal orientation thereof. The securement of the bridge to the horizontal channels of the frame also allow the position of the bridge to be adjusted as indicated by arrow 3, shown in FIG. 3. If desired, a stanchion 50 can be used at each end of the framed partition 30 to provide a freestanding screen or display structure.

The bridge arrangement has been described with respect to the preferred embodiment where there is a significant gap between the lower edge of the bridge member and the floor. This area has been maintained free of wiring used for equipment placed on the work surfaces associated with the bridge as the wiring is placed in the casual wiring trough secured to the lower surface of the bridge. This arrangement provides improved circulation of air from work station to work station. The lower surface of the bridge is also separated from the floor and is less prone to accidental forces caused by kicking of the lower surface of the bridge, banging of equipment into the lower surface of the bridge, or cleaning equipment banging the lower surface of the bridge. It also allows for reduced costs in manufacturing of the bridge. Although this reduced size is desired the bridge arrangement can be full height. It can also be appreciated the lightweight partition could be designed to connect aligned panels where the panels and the lightweight partition form a generally planer surface. In this case, the lightweight partition is designed to connect with the ends of the office panel frame.

The bridge arrangement, as shown in FIG. 3, are typically of a length of approximately 8 feet. In this case, the rectangular partition 30 includes two separate components 30A and 30B as shown in FIG. 2. These are separately upholstered components, or separately manufactured components which are trapped within the common perimeter frame 32. This simplifies manufacturing of the rectangular partition 30. It can also be appreciated that it allows the surfaces of 30A and 30B to be different, if desired, in the particular work station. For example, 30A might be a whiteboard surface, whereas 30B can be upholstered.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An office panelling system comprising a series of connected office panels in combination with bridge arrangements which collectively subdivide an open space into a plurality of workstations, said office panels comprising a structural frame to which releasable rectangular elements are secured with the releasable elements defining an exterior finish to either side of the frame, said frame including intermediate securing channels extending horizontally with each securing channel defining a freely accessible horizontal support adjacent said elements, each bridge arrangement including a partition forming a wall section of a workstation with one end of said partition connected to one of said panel frames at a position intermediate to the length of the respective office panel frame and an opposite end of said partition connected to a floor engaging structural support member which forms a "T" junction with said partition, and wherein said partition is several times lighter than one of said office panels of an equivalent length and height and wherein each partition is rectangular in shape, defines a large gap between a lower edge thereof and the floor and includes a lightweight core bound by an exterior frame with an exterior finish surface material secured to said lightweight core.

2. An office panelling system as claimed in claim 1 wherein said partition of each bridge has an exterior finish the same as said elements.

3. An office panelling system as claimed in claim 1 wherein each partition has a cardboard honeycomb interior.

4. An office panelling system as claimed in claim 1 wherein each floor engaging column member is of a weight many times greater than said partition and anchors the opposite end of said bridge arrangement.

5. An office panelling system as claimed in claim 1 wherein said partition has two separate components secured within a common perimeter frame.

6. An office panelling system as claimed in claim 1 wherein said partition is secured to a center post of said support member.

7. An office panelling system as claimed in claim 6 wherein said floor engaging structural support has a gently bowed front face and a back face with said centre post exposed within said back face.

8. An office panelling system as claimed in claim 7 wherein said floor engaging structural support is many times heavier than said partition and acts as an anchor for said opposite end of said partition.

9. An office panelling system as claimed in claim 1 wherein said floor engaging structural support has a horizontally curved front face and a rear face with a center post connected to said partition.

10. An office panelling system as claimed in claim 9 wherein said partition is only supported at either end thereof.

11. An office panelling system as claimed in claim 10 wherein said partition includes an accessory rail along a lower edge thereof which releasably supports a wiring trough.

12. An office panelling system as claimed in claim 1 wherein said system has at least one elongate spline formed by office panels connected in an end to end manner with said bridge arrangements extending in a general perpendicular manner relative to said spline.

13. An office panelling system as claimed in claim 12 wherein none of said bridge arrangements are located to opposite sides of said spline.

14. An office panelling system comprising a series of connected office panels forming a spine which receives power and communication wiring interior to each office panel frame, each office panel comprising a structural frame to which releasable rectangular elements are secured with the releasable elements defining an exterior finish to either side of the frame, said structural frame including intermediate securing channels extending horizontally with each securing channel defining a freely accessible horizontal support adjacent said elements; said office panelling system further including subdividing bridge arrangements with each bridge arrangement connected at an angle to said spine of office panels and forming a wall of a workstation, each bridge arrangement having one end connected to at least one securing channel of an adjacent office panel frame and an opposite end of said bridge arrangement including a floor engaging structural support member, said bridge arrangement intermediate said one end and said floor engaging structural support member including a lightweight core to which a decorative finish surface is attached, wherein each bridge arrangement includes a floor engaging support post at an end of said bridge arrangement opposite said floor engaging structural support member, said support post cooperating with said floor engaging structural support member such that said bridge arrangement when disconnected from said securing channel is self supporting in a vertical orientation.

15. An office panelling system as claimed in claim 14 wherein said floor engaging support post and said floor engaging structural support member of each bridge arrangement include floor engaging members for sliding movement of said bridge arrangement across a floor from one point of attachment to said office panels to a new point of attachment to said office panels.

16. An office panelling system as claimed in claim 15 wherein said planar core of each bridge is a lightweight core to which a decorative fabric is secured.

17. An office panelling system as claimed in claim 15 wherein said planar core of each bridge is a honey comb structure and said floor engaging structural support member is primarily of a metal material and forms a stanchion for said bridge arrangement.

18. An office panelling system as claimed in claim 15 wherein said planar core of each bridge arrangement terminates at a lower edge positioned to define a large gap between the floor and said lower edge.

19. An office panelling system as claimed in claim 18 wherein each planar core includes a perimeter frame thereabout which perimeter frame is connected to said floor engaging structural support member and secures said planar core to said securing channel of an adjacent office panel frame.

20. An office panelling system comprising a series of connected office panels forming a spine which receives power and communication wiring interior to each office panel frame and provide power and communication outlets at distributed locations along said spine, each office panel comprising a structural frame to which releasable rectangular elements are secured with the releasable elements defining an exterior finish to either side of the frame, said structural frame including open securing channels extending horizontally used to attach components to the office panel; said office panelling system further including subdividing bridge arrangements with each bridge arrangement connected at an angle to said spine of office panels and forming a wall of a workstation extending outwardly from said spine, each bridge arrangement having one end connected to at least one of said open securing channels of the structural frame of an adjacent office panel with an opposite end of said bridge arrangement including a floor engaging structural support member, each bridge arrangement intermediate said one end and said floor engaging structural support member including a planar core to which a decorative finish surface is attached, said bridge arrangements cooperating with said spine of office panels to define workstations spaced along said spine with two walls of each workstation being defined by bridge arrangements attached to said spine with a portion of said spine forming a third wall of said workstation, said third wall being located between and connected to said two walls of said workstation defined by said bridge arrangements.

* * * * *